US006195527B1

(12) United States Patent
Ziegelmuller et al.

(10) Patent No.: US 6,195,527 B1
(45) Date of Patent: Feb. 27, 2001

(54) WEB CLEANING DEVICE FOR REMOVING CONTAMINANTS FROM A MOVING SURFACE IN A PRINTER APPARATUS

(76) Inventors: Francisco Luiz Ziegelmuller; Randall J. Taylor; Carol Kathleen Dunn; George David Gross; Maria B. Carrone, all of NexPress Solutions LLC, 1447 St. Paul St., Rochester, NY (US) 14653-7103

( * ) Notice: Subject to any disclaimer, the term of this patent is extended or adjusted under 35 U.S.C. 154(b) by 0 days.

(21) Appl. No.: 09/570,090

(22) Filed: May 12, 2000

(51) Int. Cl.[7] ..... G03G 21/00
(52) U.S. Cl. ..... 399/352
(58) Field of Search ..... 399/352, 123; 15/256.5, 256.51

(56) References Cited

U.S. PATENT DOCUMENTS 4,110,035 8/1978 Kamata ..... 355/15
4,568,174 2/1986 Stange ..... 355/15
5,075,733 12/1991 Weissberger et al. ..... 355/300

*Primary Examiner*—Quana M. Grainger
(74) *Attorney, Agent, or Firm*—James D. Leimbach

(57) ABSTRACT

A web cleaning device for cleaning contaminants from a moving surface in a printer apparatus. The cleaning device includes a nesting structure having a longitudinally extending internal surface for supporting a coil of a web fabric extending in a longitudinal direction and an external surface located opposite to the internal surface. A lip member forms a part of the nesting structure and is located adjacent a pay out end of the coil. The pay out end of the coil is wrapped about the lip member and further wrapped about the external surface of the nesting structure. The web fabric is also wound about a take-up spindle that is spaced from the coil. A portion of the web fabric from the pay out end of the coil to the external surface of the nesting structure provides a hairpin type curvature to the path of the web fabric to reduce tendency of the web fabric to bind during pay out of the web fabric from the pay out end of the coil.

19 Claims, 8 Drawing Sheets

WEB CLEANING DEVICE FOR REMOVING CONTAMINANTS FROM A MOVING SURFACE IN A PRINTER APPARATUS

BACKGROUND OF THE INVENTION

1. Field of the Invention

This invention relates generally to web cleaning devices for cleaning contaminants from a moving surface in a printing apparatus such as an electrostatographic reproduction apparatus. It is particularly suitable for cleaning contaminants off a moving surface in the form of a drum or a belt.

2. Description Relative to the Prior Art

As noted in U.S. Pat. No. 5,075,733, it is well known since the introduction of plain paper desk-top copiers to use a disposable cleaning web for light-duty cleaning of image or other moving members. Typically, a cleaning web of cloth or paper is supplied on a supply spool or bobbin, trained about a pressure roller and taken up on a take-up spool or bobbin. The pressure roller is urged by a spring into contact with the image member to clean the image member according to the surface characteristics of the web and the amount of pressure applied by the pressure roller. The take-up roller is indexed periodically by its own separate motor, or by a substantially reduced drive between it and the main drive on the image forming device, for example, the drive for a photoconductive drum. Still other web cleaning devices are disclosed in U.S. Pat. Nos. 4,110,035 and 4,568,174. The devices disclosed in these latter patents include a path for the web cleaner between supply and take-up that involves the additional use of rollers which add an expense to the web cleaning device.

In order to reduce the costs of web cleaning devices it is known to use a web cleaning device I0 such as shown in FIG. 1 wherein there is schematically shown a fabric cleaning web supply spool or bobbin 12 that is supported within a U-shaped structure 14 so that the supply spool or bobbin 12 does not have its core 13 rotatively mounted and is thus free to move within the U-shaped structure. As shown, the cleaning web material 15 is wound about the supply spool or bobbin in a clockwise direction and then payed out through an opening 11 in the U-shaped structure so that the cleaning web material web is caused to bend about a lip 11*a* of the opening and then about the bottom 14*a* of the U-shaped structure and is in tension between the bottom of the U-shaped structure and the take-up spool or bobbin 16. The cleaning web material is then wound in a counterclockwise direction about the take-up spool or bobbin, which is motor driven through a suitable gear reduction. The cleaning web 15 is pressed by the bottom of the U-shaped structure against a moving surface 17 being cleaned to remove contaminants 18, such as toner dust or paper dust therefrom (shown greatly enlarged). The contaminants remain with the fabric and are sealed off by being wrapped in the successive plies of the web as the web is wound on the take-up spool or bobbin. A problem with the web cleaning device shown in FIG. 1 is that, as the supply of the web cleaning material exits through the opening, there is a tendency of the core 13 to be moved into the opening in the U-shaped structure, causing more than one wrap or ply of the fabric to exit at the same time, which eventually leads to binding. This binding leads to a failure of further indexing of the web cleaning material from the supply spool or bobbin and a bowing on the take-up spool that can be permanently damaged.

SUMMARY OF THE INVENTION

It is, therefore, an object to the invention to overcome the problems associated with the prior art to provide a more reliable and inexpensive web cleaning device. These and other objects of the invention, as will become more apparent from the description of the preferred embodiments of the invention, are realized, in accordance with a first aspect of the invention, by a web cleaning device for cleaning contaminants from a moving surface in a printer apparatus, the cleaning device comprising a nesting structure having a longitudinally extending internal surface for supporting a coil of a web fabric extending in a longitudinal direction and an external surface located opposite to the internal surface; a lip member forming a part of the nesting structure and located adjacent a pay out end of the coil; a web fabric having a supply formed as the coil and located in the nesting structure, the web fabric having a portion forming a pay out end of the coil that is wrapped about the lip member and further wrapped about the external surface of the nesting structure, the web fabric being also wound about the take-up spindle that is spaced from the coil, a portion of the web fabric from the pay out end of the coil to the external surface of the nesting structure providing a hairpin type curvature to the path of the web fabric to reduce tendency of the web fabric to bind during pay out of the web fabric from the pay out end of the coil.

In accordance with a second aspect of the invention there is provided a method of employing a web cleaning fabric for cleaning contaminants from a moving surface in a printer apparatus, the method comprising supporting a supply spool or bobbin that includes a coil of the web cleaning fabric in a nesting structure; paying out the web cleaning fabric from the coil in the nesting structure by advancing the web cleaning fabric through a hairpin turn upon exiting of the web cleaning fabric from the nesting structure; guiding the web cleaning fabric directly after the hairpin turn about an external surface of the nesting structure wherein the web cleaning fabric engages the moving surface; and advancing the web cleaning fabric to a take-up spool or bobbin.

In accordance with a third aspect of the invention there is provided a customer replaceable component comprising a supply spool or bobbin of web cleaning fabric having a coil of web cleaning fabric wrapped about a core in a first direction; a take-up spool or bobbin to which the web cleaning fabric is attached; a spring biased plunger member forming a part of the take-up spool or bobbin and located on one end thereof; and a cap located on a second end of the take up spool or bobbin, the cap including a notch for receiving a driving member.

In accordance with a fourth aspect of the invention there is provided apparatus for cleaning contaminants from a moving surface in a printer, the apparatus comprising a nesting structure for supporting a supply spool or bobbin that includes a coil of web cleaning fabric; a lip structure located adjacent a pay out end of the coil, whereby the pay out end of the web cleaning fabric is advanced through a hairpin turn upon exiting of the web cleaning fabric from the nesting structure; a surface for guiding the web cleaning fabric directly after the hairpin turn about an external surface of the nesting structure, wherein the web cleaning fabric engages the moving surface; and a take-up spool or bobbin upon which the web cleaning fabric is collected after use in cleaning contaminants from the moving surface.

BRIEF DESCRIPTION OF THE DRAWINGS

The invention and its objects and advantages will become apparent upon reading the following detailed description and upon reference to the drawings, in which.

DETAILED DESCRIPTION OF THE PREFERRED EMBODIMENTS

While the present invention will be hereinafter described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Although the cleaning apparatus of the present invention is particularly well adapted for use in an electrostatographic printing machine, such as an electrographic or electrophotographic printing machine, it should be evident from the following discussion that it is equally well suited for application in a wide variety of devices and is not necessarily limited to the particular embodiment shown herein. The cleaning device of the invention may be used to clean any moving surface in a printing machine including a photoconductive or electrographic recording member in the form of a belt or a drum or belts or drums used for imaging or transfer of images or transporting of receiver sheets.

Inasmuch as printing machines are well known, the invention will be described with reference to particular parts forming a part of and useful in the description of this invention, it being understood that parts not described herein may be selected from those known in the prior art.

The invention finds particular use in a printer apparatus such as an electrostatographic reproduction apparatus of the type illustrated in U.S. application Ser. No. 08/900,696, filed Jul. 25, 1997 in the names of Tombs et al, the contents of which are incorporated herein by reference. In Tombs et al an electrostatographic reproduction apparatus is disclosed as a series of color station modules that are provided for individually depositing an electroscopic toner of different colors as paper receiver sheets are serially moved from transfer station to station through the series of color station modules to form multicolor images thereon. In order to serially advance discrete paper sheets through the transfer stations, the paper sheets are supported upon a paper transport belt. In the course of operating over time, the two surfaces of the paper transport belt electrostatically, or otherwise, attract toner and paper fibers or other contaminants onto their surfaces. The web cleaning device of the invention is particularly suited for cleaning the back surface of the paper transport belt, i.e., the surface of the belt that does not support the paper receiver sheets.

Figure 1:
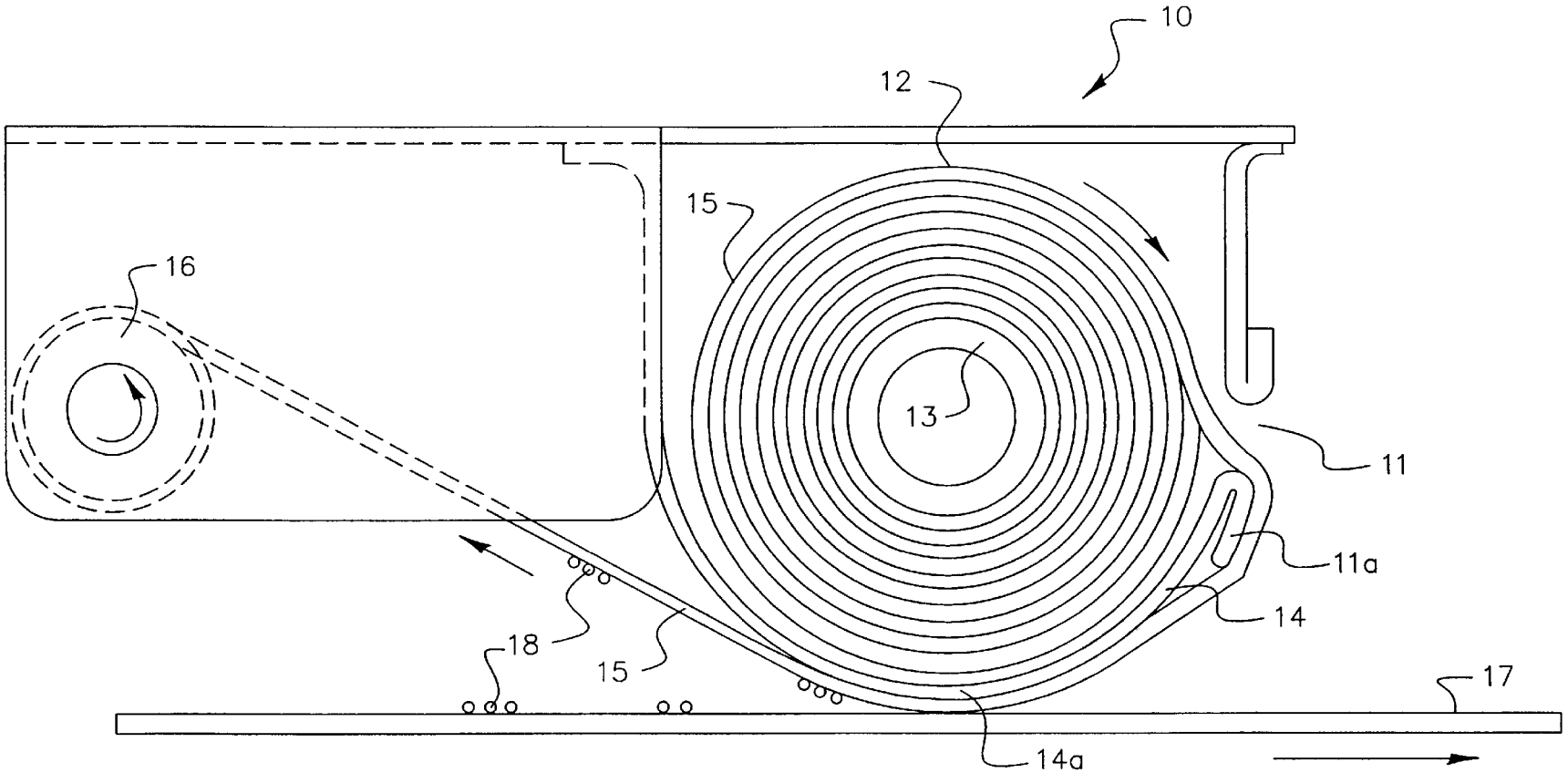
FIG. 1 (PRIOR ART)
FIG. 1 is an illustration in schematic form of a prior art web cleaning device having a respective supply and take-up spool or bobbin.
Figure 2:
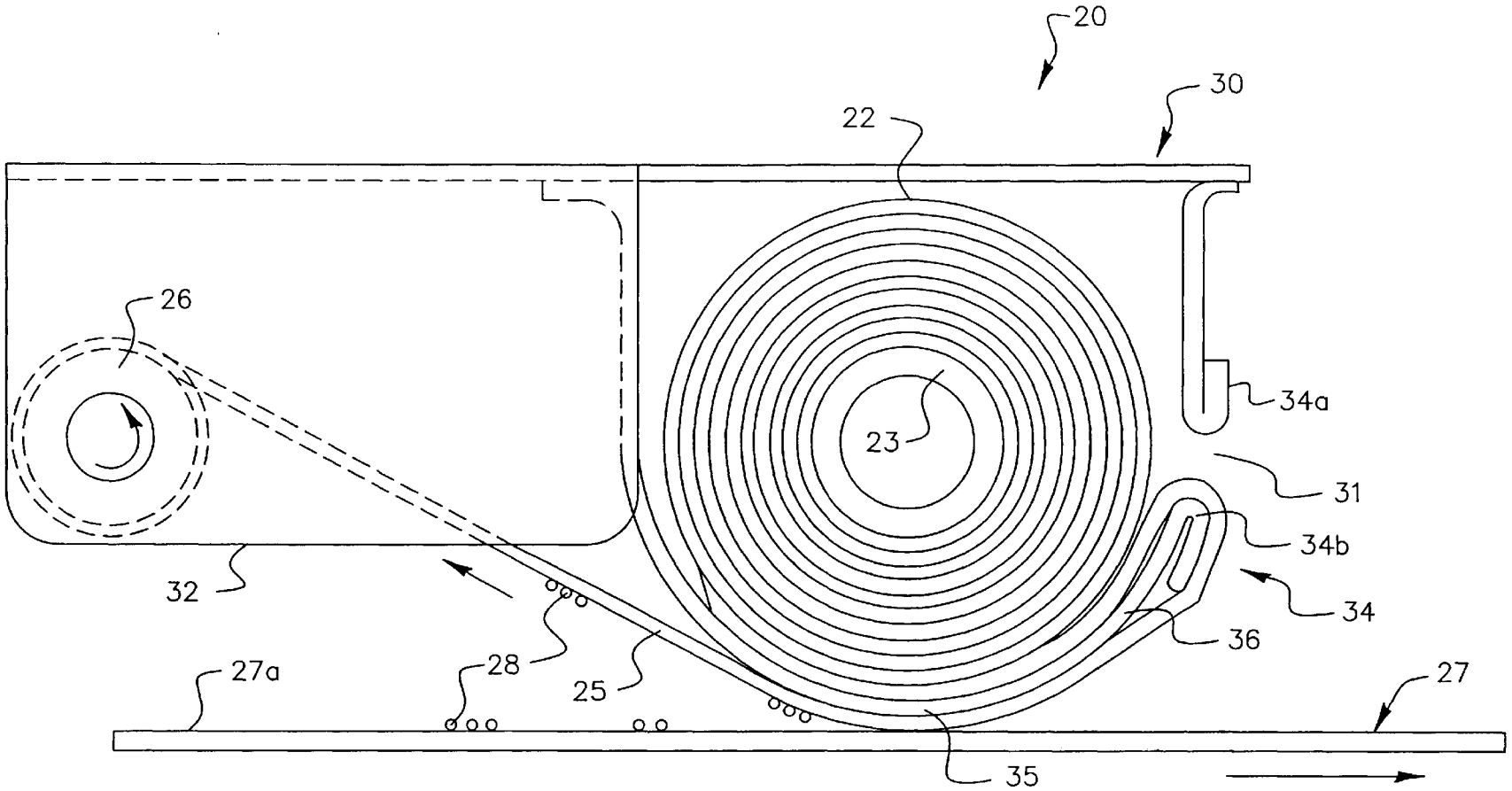
FIG. 2 is a side elevational view in schematic form of a web cleaning device in accordance with the invention.

With reference now to FIG. 2 there is illustrated schematically the web cleaning device 20 of the invention as it is supported for cleaning of contaminants 28 from the inner surface 27*a* of the paper transport belt 27. As may be seen, a supply spool or bobbin 22 of fabric, in the form of a web 25, is wrapped about a core 23 in a counterclockwise direction as illustrated in FIG. 2. The core may be formed of cardboard or of stronger materials, such as aluminum or steel, to avoid excessive bowing due to drag on the fabric. The fabric can be made of any of several materials, such as polyester, rayon, nylon, and others, or blends of these materials. Preferably, the fabric has a high tear strength, but it does not have to have high resistance to heat except when used in an environment where it is used for cleaning of fuser rollers when oil, higher pressure and heat are present. The fabric may be attached to the supply core, such as by glue or tape, or attached by cinching. The coil of fabric and supply core upon which it is wound comprise the supply spool or bobbin. The supply spool or bobbin 22 rests in a U-shaped nest member or structure 36 wherein the coil of the web fabric is wound counterclockwise about the core 23. The outer layer of the core fabric as it is payed off the coil is wrapped about a lower lip portion 34*b* of a structure that defines with an upper lip portion 34*a* an opening 31 in the U-shaped structure. The supply spool or bobbin is seated in the U-shaped structure or nest member and is not supported at its ends and is, thus, free to move about the U-shaped structure and to rotate therein to allow fabric to pay off the supply spool or bobbin. The web of fabric extends from the lower lip portion and is wrapped about the outside bottom portion 35 of the U-shaped structure or nest member and has a second end thereof attached to the take-up spindle or core which forms part of the take-up spool or bobbin 26. A motor drive, as will be described later, is provided to the take-up spool or bobbin to drive the spool or bobbin in the counterclockwise direction to wind the cleaning web thereon. When drive is imparted to the paper transport web, the motor drive is activated to index the cleaning web at 0.004 inches (0.10 mm) per minute on average, or higher, and preferably at twice that rate. The cleaning web indexing speed will, of course, change with diameter of the take-up roller as the web material accumulates on the take-up roller unless provision is made for adjusting index speed with take-up radius, for example, such as by adjusting duty cycle of the drive to the indexing motor with on-time use of a particular cleaning web. It has been found that by having the fabric of the cleaning web wound in the same direction about both the supply and take-up spools, i.e., as viewed in the view of FIG. 2, both are wound counterclockwise, or both may be wound clockwise, as would be seen from the opposite end. Distinct benefits are obtained by allowing the web to be payed out from the supply spool along the bottom lip portion of the U-shaped opening. The sharp hairpin turn 34 of the web cleaning fabric about the bottom lip portion 34*b* relieves the supply roll of any meaningful force that would tend to cause the supply core to be moved into the opening in the U-shaped structure and lead to binding of the web fabric. As used herein, the wrap of the payed off portion of the fabric about the lower lip portion is deemed to be, as shown in FIG. 2, a hairpin turn, i.e., a turn in path movement that is accomplished in a relatively narrow acute angle and is distinguishable from that shown in FIG. 1 wherein the wrap of the payed out portion of the fabric about the lower lip portion 11*a* is not considered to be a hairpin turn. The web fabric engages the belt surface 27*a* being cleaned with at least a wrap of 0.02 inches and, preferably, over 0.06 inches. As can be seen in FIG. 2 the U-shaped structure is supported so that the bottom portion 35 thereof, with the cleaning web wrapped against said bottom portion, is in position to engage under the light pressure, the inside surface of the paper transport belt. It will also be noted from FIG. 2 that the cleaning web 25 engages the surface 27*a* of the paper transport belt at a location where the cleaning web is wrapped about the bottom outside portion 35 of the U-shaped structure, which location is opposite that where the supply spool rests upon the bottom portion on the inside of the U-shaped structure. It is preferred that the cleaning web be advanced in a direction opposite to that of movement of the surface 27*a* being cleaned. Wrap between the paper transport belt and the U-shaped structure is determined by the radius of curvature of the U-shaped structure and location of other structures, not shown, which also engage the paper transport belt.

Figure 3:
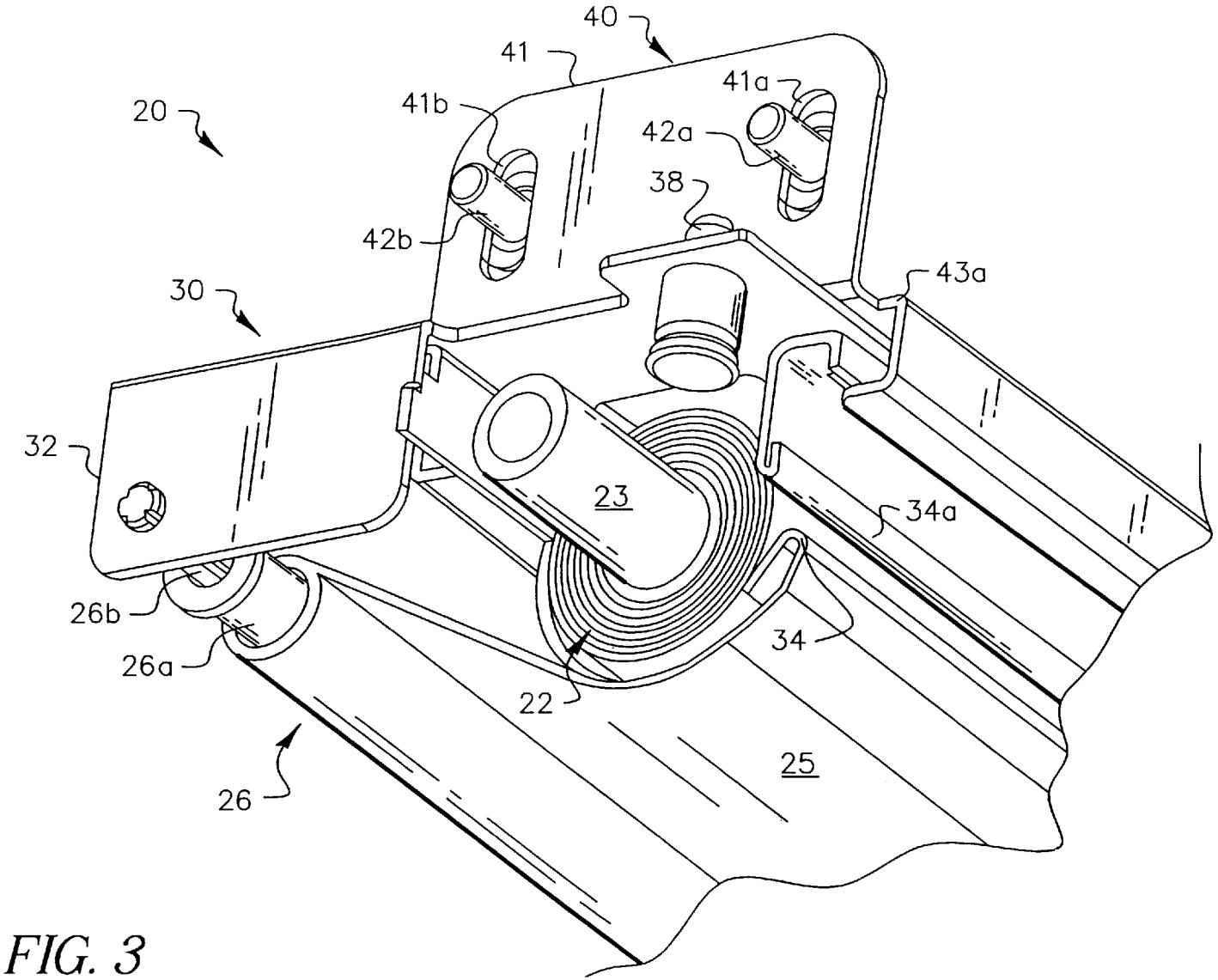
FIG. 3 is a first perspective view of a front portion of the web cleaning device of FIG. 2.
Figure 4:
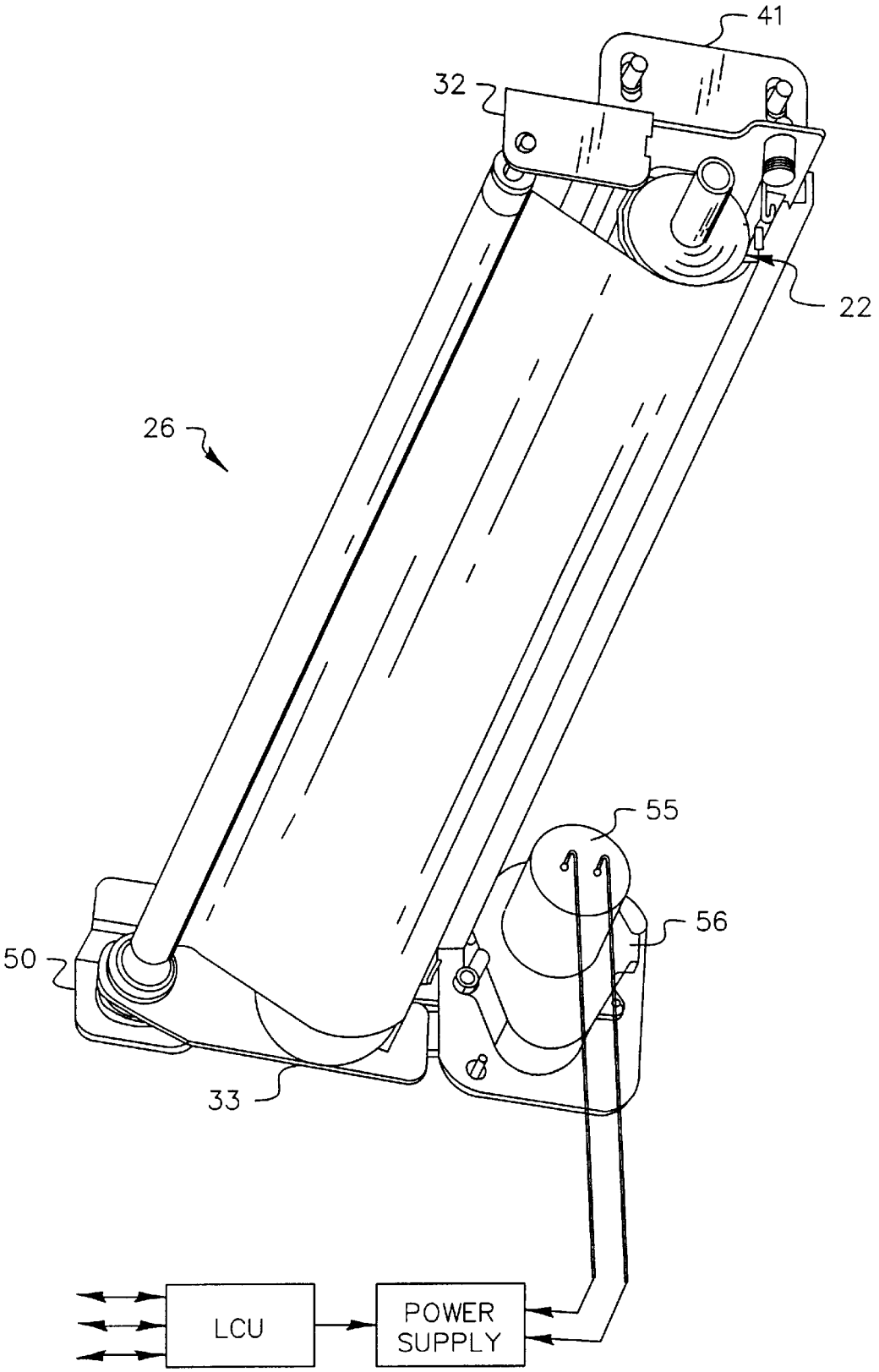
FIG. 4 is a second perspective view of the web cleaning device of FIG. 2 taken from a different vantage point from that of FIG. 3.
Figure 5:
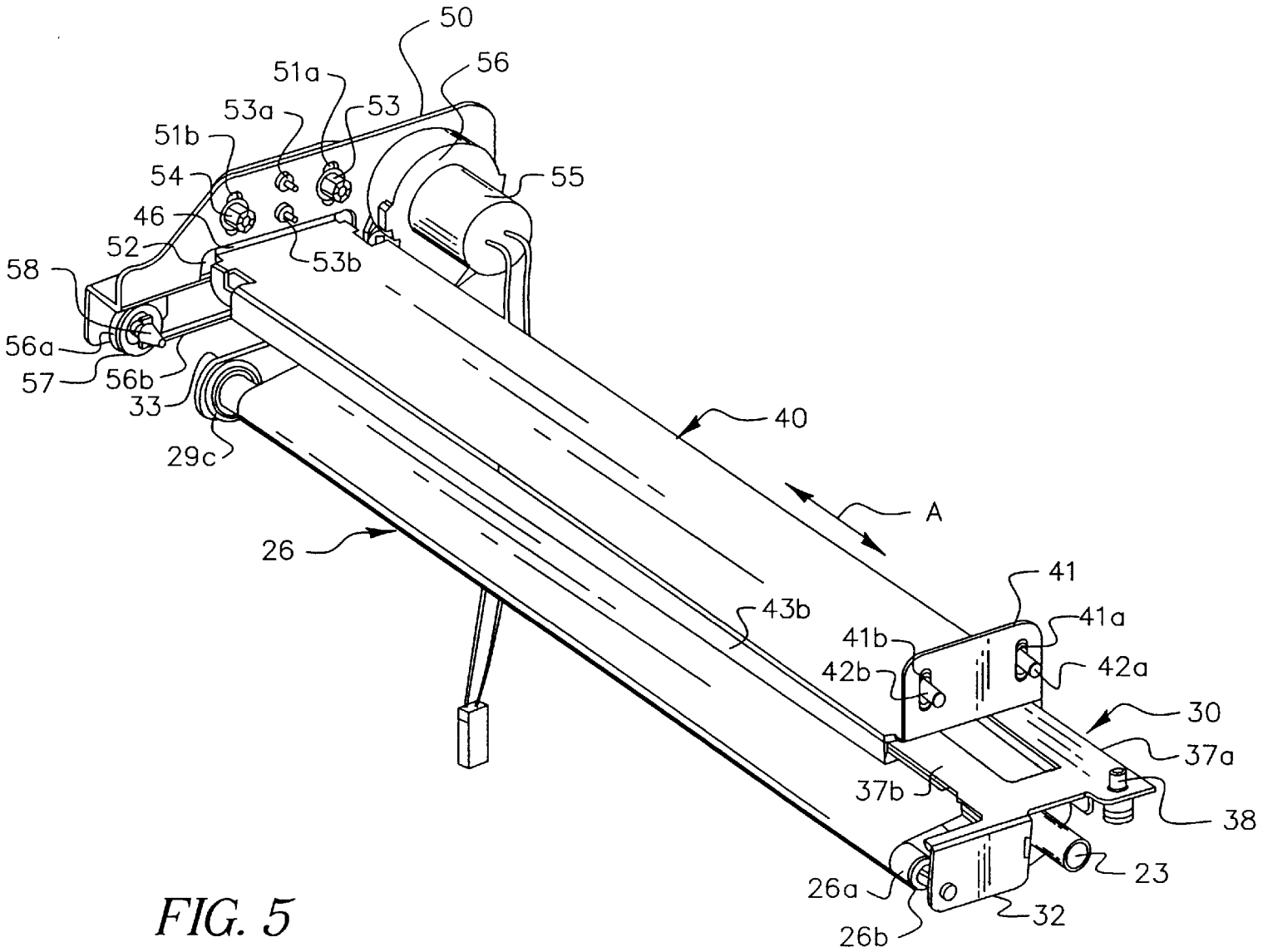
FIG. 5 is a third perspective view of the web cleaning device of FIG. 2 taken from still another vantage point from that of FIGS. 2 and 3.

With reference now to FIGS. 3–5, it can be seen that the U-shaped structure is part of a first longitudinally extending metal assembly 30 that can be removed from the printer machine. The first assembly includes a down-turned flange 32 having a hole or opening for supporting one end of the take-up spool or bobbin 26. Outwardly projecting flanges 37*a* and 37*b* are also provided on right and left sides of the first metal assembly which serve as support guides for moving the first assembly along rails formed in a second longitudinally extending metal assembly 40. The first and second metal assemblies extend from the front to the back of the printer machine, whereas movement of the paper transport belt 27 is transverse to and, more preferably, perpendicular to this longitudinal direction. The second assembly 40 contains the rails or tracks 43*a* and 43*b* for supporting the first assembly 30. A third assembly 50 is fixed to the second assembly 40, as will be described below, and the locked assemblies are affixed to the back of the machine frame by bolts 53, 54. On this third metal assembly 50 there is supported an electric motor 55, preferably DC, although an AC motor can also be used. It is preferred to operate the DC motor at a lower than rated voltage to extend the life of the motor. The DC motor is connected to a power supply which, in turn, is controlled by a logic and control unit of the printer apparatus which enables the power supply to provide power to the motor while the surface being cleaned is moving. Alternatively, the motor may be eliminated, and a mechanical drive may be provided between the drive for the belt being cleaned and a gear wheel 56*a*. The housing for the electric motor may also include a gear case 56 having gears for reducing the rotation rate to the gear wheel 56*a* that is rotatively connected to the gears in the gear case 56 by a timing belt 56*b* and drive pulley (not shown) which is connected to the output shaft of the gear case. The third metal assembly 50 includes an opening 52 for receiving an up-turned flange 46 at the rear end of the second assembly 40 for supporting the rear end of the second assembly. The up-turned flange 46 includes a pair of relatively wide vertical slots (not shown) that match with slots 51*a*, 51*b* which are provided in the third assembly through which bolts 53, 54 extend to attach and locate the locked assemblies 40 and 50 to the machine frame at the rear of the machine. The bolts 53, 54 extend through the relatively wide vertical slots in the up turned flange 46. However, to locate and secure the second assembly 40 to the third assembly 50 before mounting the combined or locked assemblies 40 and 50 to the machine frame, there are provided two PEM inserts (bolts or tapered guide pin screws, trademark of Penn Engineering and Manufacturing Corp.) 53*a*, 53*b* added to the up-turned flange 46. These PEM inserts go into smaller slots (not shown) on assembly 50 and the two assemblies 40, 50 are locked via small nuts attached to these smaller bolts. Before tightening the small nuts, the assemblies 40 and 50 are aligned relative to each other so as to insure that the take-up spool will be in position to mate with the gear wheel 56*a*.

Figure 6:
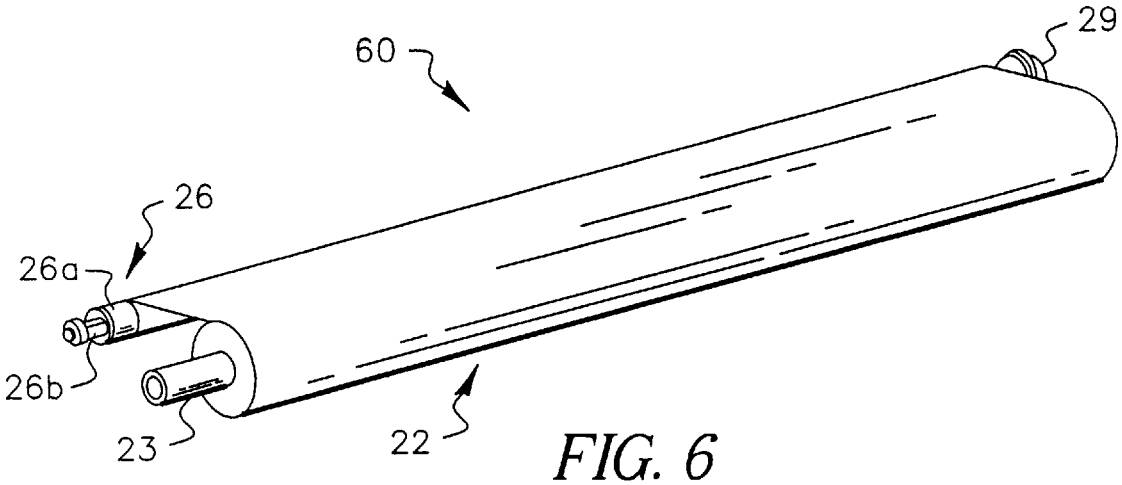
FIG. 6 is a perspective view of a customer replaceable component of the web cleaning device of FIG. 2 and includes a supply spool or bobbin and the take-up spool or bobbin and a cleaning web fabric connected to both the supply spool or bobbin and the take-up spool or bobbin.
Figure 7:
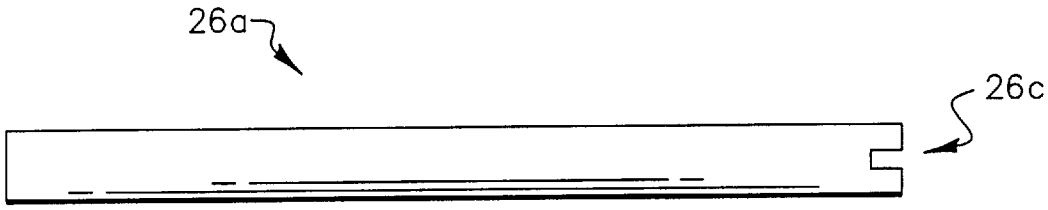
FIG. 7 is a front elevational view of a take-up spindle forming a part of the take-up supply spool or bobbin of the customer replaceable component of FIG. 6.
Figure 8:
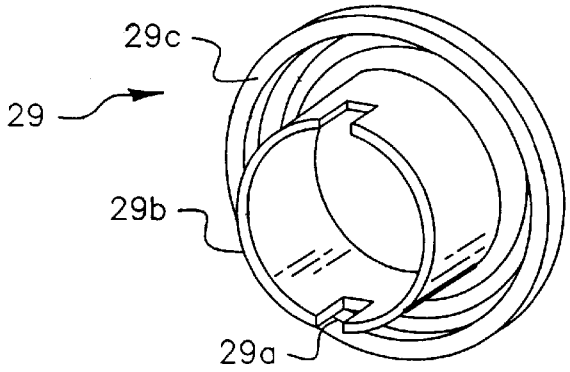
FIG. 8 is a perspective view of an end cap attached to a rear end of the spindle of FIG. 7.
Figure 9A:
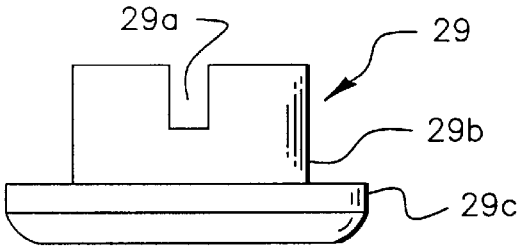
FIGS. 9*a* and *b* are top and front elevational views of the end cap of FIG. 8.
Figure 9B:
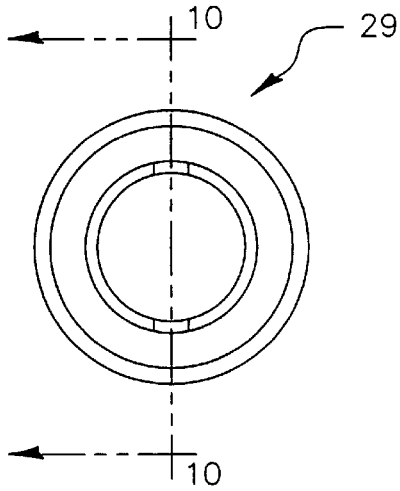
Figure 10:
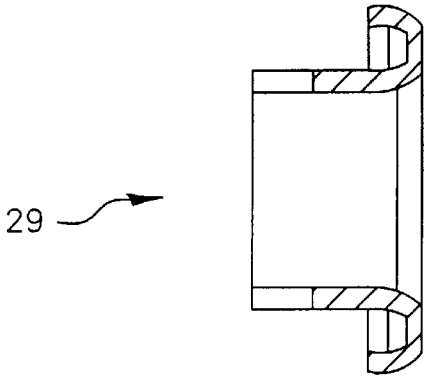
FIG. 10 is a sectional view taken on the section line A—A of FIG. 9*b*.
Figure 11A:
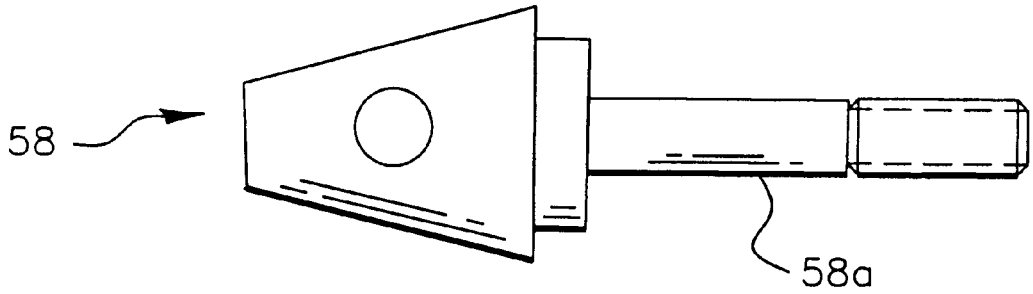
FIGS. 11*a, b* and *c* are respectively top and side and front elevational views of a tapered guide or pin that is used for alignment and support of the take-up spool or bobbin when the web cleaning device is slid into and supported in a printer apparatus such as an electrostatographic reproduction apparatus.
Figure 11B:
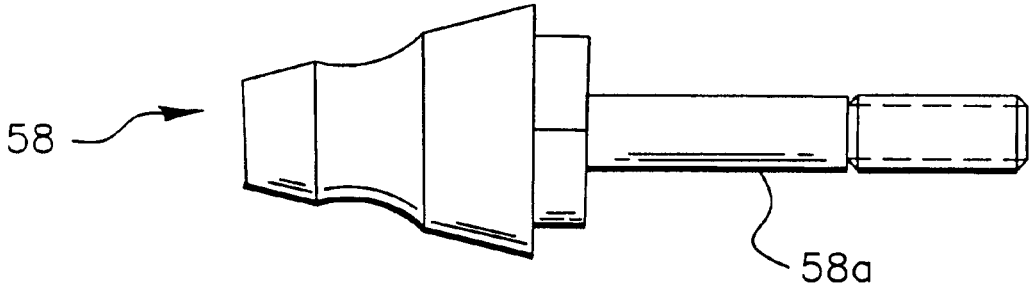
Figure 11C:
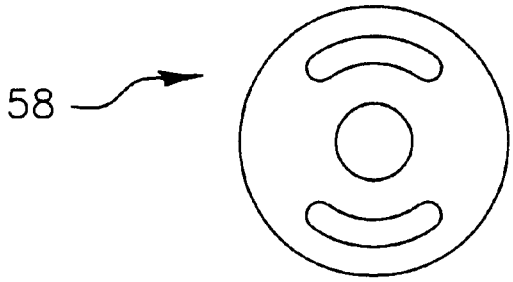

The plastic gear wheel 56*a* includes ears 57 integrally molded on a front face thereof. A tapered guide pin 58 is secured to assembly 50 and has a shaft that extends through a central opening of the gear wheel 56*a*. The guide pin 58 does not rotate with the gear wheel. However, it could be made a part of the gear wheel and rotate therewith. The tapered guide pin is used for receiving and guiding a cap secured to the rear end of the take-up spindle. Details regarding the tapered guide pin are shown in FIGS. 11*a, b,* and *c*. As may be seen in FIGS. 11*a* and *b*, the tapered guide pin includes the shaft 58*a* which extends within an opening of the gear wheel 56*a*, and the tapered guide pin extends forwardly towards the rear end of the take-up spool or bobbin 26*a*, as shown in FIG. 5. The rear end of the take up spool or bobbin's spindle 26*a* has a cap 29 mounted thereon, such as by a press fitted connection, and which is, thus, fixed to the take-up spindle 26*a* so that they rotate together, as shown in FIG. 6. Details of this cap are shown in FIGS. 9*a, b,* and 10. A rearwardly facing portion of this cap 29 extends through an opening or aperture in a rear flange 33 formed on the first assembly 30. The rearwardmost facing portion of this cap features a slot 29*a* formed within a cylindrical wall 29*b*. The slot 29*a* is aligned with a slot 26*c* at the rear end of the take-up spindle or core. The slots 29*a* and 26*c* are adapted to mate with the ears 57 molded, or otherwise formed, on the front facing surface of the gear wheel. Thus, drive imparted to the gear wheel will cause drive from the ears 57 to drive the take-up spindle and the cap. Enlarged flange portions 29*c* are formed on a forwardmost facing portion of the cap to provide an enlarged diameter to serve as a stop against the front facing surface of the rear flange 33 of the first assembly.

The front end of the second assembly includes, in a front facing upwardly turned flange 41, a plurality of slots 41*a*, 41*b* into which bolts 42*a*, 42*b* are provided for securing the second assembly 40 to the front portion of the machine frame (not shown).

As noted above, the second assembly 40 and third assembly 50 are assembled to each other and adjusted for proper alignment. The third assembly 50 includes the electric motor 55 and gear case assembly 56, and the timing belt 56*b* and the gear wheel 56*a*. The second assembly 40 is mounted to the third assembly 50 by the small bolts 53*a*, 53*b*. With the second assembly and third assembly properly relatively aligned to each other and locked together, the assemblies 40, 50 are then mounted to the machine frame at the rear of the machine using the larger bolts 53, 54.

The front flange 41 of the second assembly is mounted to the front machine frame, as discussed above, using bolts 42*a* and 42*b* which extend through slots 41*a* and 4.2*b*, respectively, that are formed in flange 41. The first assembly 30, when it is outside of the printer machine or apparatus, has the customer replaceable component assembled thereto. With reference to FIG. 6, the customer replaceable component 60 includes the supply spool or bobbin and the take-up spool or bobbin. The supply spool or bobbin has a coil of the web cleaning fabric wound thereabout. The take-up spool or bobbin includes a plunger 26*b* inserted into the take-up core at the front end of the take-up core or spindle and the cap 29 inserted into the rear end of the take-up core or spindle. The respective ends of the web fabric are attached to the take-up and supply spools or bobbins and are provided by the manufacturer of same on such spools or bobbins. As an example, the web fabric may be non-woven rayon with 35% polyester blend at 1.5 ounces per square yard. The fabric end may be attached to the take-up spindle or core using glue, tape (such as double sided tape), or other adhesives to prevent delamination as the web fabric is pulled out from the supply spool. The range of web fabric thickness is from 0.003 inches to 0.015 inches. The thicker the fabric, the lower the number of wraps on the supply spool for the same diameter and, consequently, the smaller the usable length of the fabric and lower life. The take-up and supply spindles or cores may be both formed of cardboard. The take-up spool core may be made stronger than the supply spool core since drag on the fabric may cause bowing to take place in the take-up core. The take-up spool should be sufficiently rigid to overcome the drag of the fabric and to avoid too much bowing. The supply spool or bobbin may be mounted in the U-shaped structure by merely laying the supply spool or bobbin in the U-shaped structure. The take up spool is then positioned so that the fabric web is payed out and wrapped around the lower lip 34*b* and brought under the U-shaped structure bottom portion 35. The rear end of the take-up spool having the cap 29 may have the cylindrical wall 29*b* then located in the hole of the rear flange 33. A forward facing end of the take-up spool or bobbin having a plunger 26*b* already installed on the core or spindle 26*a* is then mounted in a hole of the downwardly turned flange 32 formed in the first assembly. The spring-loaded plunger 26*b* is mounted on, and concentric with, the spindle 26*a* and facilitates placement of the forward end of the take-up spool or bobbin in this hole. The spring-loaded plunger, thus, allows an easy installation of the customer replaceable component into the first assembly and applies a force on the take-up core to stay coupled to the motor driven gear wheel 56*a*. Thus, the take-up spindle has each of its two ends mounted for rotation by a flange on the first assembly. The first assembly, with the customer replaceable component 60 mounted thereon, is then introduced into the printer machine and mounted to the second assembly by sliding the flanges 37*a*, 37*b* along rails 43*a*, 43*b*, respectively. Thus, mounting and dismounting of the first assembly 30 with the customer replaceable component 60, that includes the take-up and supply spools or bobbins, is easily accomplished by moving the first assembly along the rails of the second assembly in the longitudinal direction shown by the arrow A (FIG. 5). When advancing the first assembly rearwardly, the cap 29 mounted on the rear end of the spindle of the take-up spool or bobbin is guided onto the tapered pin 58. Because of the presence of the tapered pin there is provided relatively easy mounting of the rear portion of the take up spool or bobbin without the need for the operator to see or otherwise guide the rear portion of the take-up spool or bobbin. The front facing portion of the take-up spool may be rotated to lock the slot 29*a* on the cap onto the ears 57 of the gear wheel so that the take-up spool or bobbin is thereby rotatively connected to the gear wheel 56*a*. The front end of the first assembly 30 is secured to the machine frame at the front of the machine by connection of a plunger pin 38, mounted on the first assembly, into an aperture (not shown) in the machine frame.

Thus, as electrical power is applied to the motor 55 the gearing is driven and drives the timing belt 56*b* which in turn drives the gear wheel 56*a* which, in turn, causes the take-up spool 26 to rotate or be indexed. Drive to the motor will typically be provided while the transport belt or other surface being cleaned is moving. The shape of the bottom of the U-shaped structure is provided with a high radius of curvature and is located such that there is some wrap of the paper transport belt thereabout while maintaining a low deflection of the paper transport belt. The desirable radius of curvature can be from one inch to three inches. A higher radius of curvature reduces engagement of the U-shaped member bottom portion with the web fabric and reduces normal forces and sensitivity to the position of other members that are operating on the paper transport web. There is also provided increased wrap with the paper transport web.

A red stripe may be placed on the web fabric near the end of the web fabric supply spool and adjacent to a front facing edge of the web fabric (closer to the field of view of the operator) so as to provide a visual indication to the operator when a majority of the web fabric has been used. The replacement of the web cleaner fabric can also be determined by the usable length of the cleaning fabric and the speed or time of indexation so that it can be accurately estimated to occur within a timeframe which may be indicated by the printer software. When a new fabric is installed, the time counter can be reset.

Although it is preferred to have the supply spool or bobbin merely be dropped into the U-shaped structure or member for ease of assembly of the customer replaceable component onto the first assembly ,the invention contemplates that the core of the take-up supply may also be supported for rotation. Although the U-shaped structure is preferred, it is contemplated that other shapes may be used for supporting the take-up supply spool or bobbin and that the external surface of the U-shaped structure, about which the cleaning web is wrapped for cleaning, may be of a different configuration than that shown.

The invention has been described in detail with particular reference to a presently preferred embodiment, but it will be understood that variations and modifications can be effected within the spirit and scope of the invention.

Parts List

10 web cleaning device
11 opening
11*a* lip
12 supply spool or bobbin
13 core (supply)
14 U-shaped structure
14*a* bottom of the U-shaped structure
15 cleaning web
16 take-up spool or bobbin
17 surface being cleaned
18 contaminants
20 cleaning device
22 supply spool or bobbin
23 core (supply)
25 cleaning web
26 take-up spool or bobbin
26*a* a spindle or core of take-up spool or bobbin
26*b* spring loaded plunger

26*c* slot (rear end of take-up spindle)
27 paper transport belt
27*a* belt surface (surface being cleaned)
28 contaminants
29 cap
29*a* slot
29*b* cylindrical wall
29*c* flange portion
30 first metal assembly
31 opening in the U-shaped structure
32 downturned flange
33 rear flange
34 hairpin turn of cleaning web
34*a* upper lip portion
34*b* lower lip portion
35 bottom portion
36 U-shaped nest member or structure
37*a* outwardly projecting flange
37*b* outwardly projecting flange
38 plunger pin
40 second metal assembly
41 up-turned flange (front-end)
41*a* slot
41*b* slot
42*a* bolt
42*b* bolt
43*a* rail or track
43*b* rail or track
46 up-turned flange (rear end)
50 third metal assembly
51*a* slot
51*b* slot
52 opening
53 bolt
53*a* small bolt
53*b* small bolt
54 bolt
55 electric motor
56 gear case
56*a* gear wheel
56*b* timing belt
57 ears
58 tapered guide pin
58*a* shaft
60 customer-replaceable component

What is claimed is:

1. A web cleaning device for cleaning contaminants from a moving surface in a printer apparatus, said cleaning device comprising:

a nesting structure having a longitudinally extending internal surface for supporting a coil of a web fabric extending in a longitudinal direction and an external surface located opposite to the internal surface;

a lip member forming a part of the nesting structure and located adjacent a pay out end of the coil; and a web fabric having a supply formed as the coil and located in the nesting structure, the web fabric having a portion forming a pay out end of the coil that is wrapped about the lip member and further wrapped about the external surface of the nesting structure, the web fabric being also wound about the take-up spindle that is spaced from the coil, a portion of the web fabric from the pay out end of the coil to the external surface of the nesting structure providing a hairpin type curvature to the path of the web fabric to reduce tendency of the web fabric to bind during pay out of the web fabric from the pay out end of the coil.

2. The web cleaning device of claim 1 wherein the nesting structure is in the shape of a U-shaped member.

3. The web cleaning device of claim 2 wherein the U-shaped member forms part of the slide assembly, the slide assembly is slidable along a structure that extends in the longitudinal direction and is mounted in the printer apparatus in the longitudinal direction which direction is transverse to the direction of movement of the moving surface cleaned by the cleaning device.

4. The web cleaning device of claim 3 wherein drive is imparted to the take-up spool or bobbin to index the web fabric during movement of the moving member.

5. The web cleaning device of claim 4 wherein the take-up spool or bobbin includes a rearwardly facing structure having an opening that receives a tapered pin for guiding the take-up spool or bobbin onto the pin as the slide assembly is moved to the rear of the printer apparatus to locate the take-up spool or bobbin.

6. The web cleaning device of claim 5 wherein the tapered pin extends from a drive member but is not rotatively coupled to the drive member and the drive member includes a drive structure that is coupled to the take-up spool or bobbin to impart drive from the drive member to the take-up spool or bobbin.

7. The web cleaning device of claim 6 wherein the drive member is supported for rotation upon a third assembly member which has mounted thereon a motor, and the motor is mechanically connected to the drive member for rotatively driving the drive member.

8. The web cleaning device of claim 7 wherein the drive member is a gear and the drive structure comprises ears integrally molded on a surface of the gear.

9. A method of employing a web cleaning fabric for cleaning contaminants from a moving surface in a printer apparatus, said method comprising:

supporting a supply spool or bobbin that includes a coil of the web cleaning fabric in a nesting structure;

paying out the web cleaning fabric from the coil in the nesting structure by advancing the web cleaning fabric through a hairpin turn upon exiting of the web cleaning fabric from the nesting structure;

guiding the web cleaning fabric directly after the hairpin turn about an external surface of the nesting structure wherein the web cleaning fabric engages the moving surface; and advancing the web cleaning fabric to a take-up spool or bobbin.

10. The method according to claim 9 wherein the web cleaning fabric unwinds from the supply spool or bobbin in the same direction that it winds upon the take-Lip spool or bobbin.

11. A customer replaceable component for use in the method of claim 9, the customer replaceable component comprising:

a supply spool or bobbin of web cleaning fabric having a coil of web cleaning fabric wrapped about a core in a first direction;

a take-up spool or bobbin to which the web cleaning fabric is attached;

a spring biased plunger member forming a part of the take-up spool or bobbin and located on one end thereof; and a cap located on a second end of the take up spool or bobbin, the cap including a notch for receiving a driving member.

12. The customer replaceable component of claim 11 wherein the web cleaning fabric is wrapped about the supply spool or bobbin in the same direction that the web cleaning fabric is wrapped about the take-up spool or bobbin.

13. The method according to claim 10 wherein the web cleaning fabric is mounted in the printer apparatus by sliding a carrier structure supporting the web cleaning fabric supply and take-up spools or bobbins in a direction transverse to that of movement of the moving surface wherein sliding movement of the carrier structure causes a cap end of the take up spool or bobbin to be engaged by a driving structure supported by the printer apparatus.

14. An apparatus for cleaning contaminants from a moving surface in a printer, said apparatus comprising:

a nesting structure for supporting a supply spool or bobbin that includes a coil of web cleaning fabric;

a lip structure located adjacent a pay out end of the coil whereby the pay out end of the web cleaning fabric is advanced through a hairpin turn upon exiting of the web cleaning fabric from the nesting structure;

a surface for guiding the web cleaning fabric directly after the hairpin turn about an external surface of the nesting structure wherein the web cleaning fabric engages the moving surface; and a take-up spool or bobbin upon which the web cleaning fabric is collected after use in cleaning contaminants from the moving surface.

15. The apparatus of claim 14 wherein the nesting structure includes flanges to form a slide assembly, the slide assembly is slidable along a structure that is mounted in the printer apparatus to locate the slide assembly in the printer apparatus.

16. The apparatus of claim 15 wherein the take-up spool or bobbin includes a rearwardly facing structure having an opening that receives a tapered pin for guiding the take-up spool or bobbin onto the pin as the slide assembly is moved to the rear of the printer apparatus to locate the take-up spool or bobbin.

17. The apparatus of claim 16 wherein the tapered pin extends from a drive member and the drive member includes a drive structure that is coupled to the take-up spool or bobbin to impart drive from the drive member to the take-up spool or bobbin.

18. The apparatus of claim of 17 wherein the drive member is a gear and the drive structure comprises ears integrally molded on a surface of the gear.

19. The apparatus of claim 14 wherein the radius of curvature of the guide structure is from one inch to three inches.

* * * * *